US005503763A

United States Patent [19]

Podszun et al.

[11] Patent Number: 5,503,763

[45] Date of Patent: Apr. 2, 1996

[54] ELECTROVISCOUS LIQUID

[75] Inventors: Wolfgang Podszun; Robert Bloodworth, both of Köln; Günter Oppermann, Leverkusen, all of Germany

[73] Assignee: Bayer Aktiengesellschaft, Leverkusen, Germany

[21] Appl. No.: 211,019

[22] PCT Filed: Sep. 4, 1992

[86] PCT No.: PCT/EP92/02044

§ 371 Date: Mar. 11, 1994

§ 102(e) Date: Mar. 11, 1994

[87] PCT Pub. No.: WO93/06199

PCT Pub. Date: Apr. 1, 1993

[30] Foreign Application Priority Data

Sep. 19, 1991 [DE] Germany ..... 41 31 142.6

[51] Int. Cl.[6] ..... C09K 3/00; H01B 3/18

[52] U.S. Cl. ..... 252/73; 252/78.3; 252/572; 252/570

[58] Field of Search ..... 252/572, 570, 252/73, 78.3

[56] References Cited

U.S. PATENT DOCUMENTS

| | | | |
|---|---|---|---|
| 4,048,422 | 9/1977 | Sackmann et al. | 526/203 |
| 4,287,299 | 9/1981 | Himmelmann et al. | 430/537 |
| 4,455,264 | 6/1984 | Findeisen et al. | 260/545 R |
| 4,524,131 | 6/1985 | Himmelmann et al. | 430/523 |
| 4,645,614 | 2/1987 | Goossens et al. | 252/75 |
| 4,668,417 | 5/1987 | Goossens et al. | 252/75 |
| 4,702,855 | 10/1987 | Goossens et al. | 252/75 |
| 4,790,522 | 12/1988 | Drutchas | 267/225 |
| 4,898,267 | 2/1990 | Garrett et al. | 192/21.5 |
| 5,014,829 | 5/1991 | Hare, Sr. | 188/267 |
| 5,045,395 | 9/1991 | Podszun | 428/402 |
| 5,145,024 | 9/1992 | Doi | 180/312 |
| 5,164,105 | 11/1992 | Ishino et al. | 252/78.3 |
| 5,217,638 | 6/1993 | Hattori et al. | 252/74 |
| 5,226,500 | 7/1993 | Doi et al. | 180/312 |
| 5,268,118 | 12/1993 | Bloodworth et al. | 252/73 |
| 5,269,811 | 12/1993 | Hayes et al. | 623/3 |
| 5,376,294 | 12/1994 | Okada et al. | 252/78.3 |
| 5,391,314 | 2/1995 | Minemura et al. | 252/78.3 |

FOREIGN PATENT DOCUMENTS

| | | |
|---|---|---|
| 0265252 | 4/1988 | European Pat. Off. . |
| 0393693 | 4/1990 | European Pat. Off. . |
| 1570234 | 1/1978 | Germany . |
| 1282568 | 7/1972 | United Kingdom . |
| 1600280 | 10/1981 | United Kingdom . |

OTHER PUBLICATIONS

McGraw—Hill Dictionary of Scientific and Technological Terms, Fourth Edition, p. 850 (1989).

Journal of Applied Physics, vol. 20, Dec. 1949, pp. 1137–1140; "Induced Fibration of suspensions", W. M. Winslow, Feb. 23, 1949.

Chemical Abstract, Week 9004, Petroleum, p. 3, BRID HO8 90–026314/04 JO 1304–189–A; "Stable electro–viscous liq. with . . . ", Bridgestone Tire KK Jun. 1988.

Chemical Abstract, Week 8934, Petroleum, p. 3, JAPC HO8 89–246166/34 JO 1180–240–A; "Electrical conductive viscous fluid. . . ", Nippon Shokubai Jan. 1988.

Chemical Abstract, Week 8948, Petroleum, p. 4, BRID HO8 89–353837/48 JO 1266–191–A; "Stable electro–viscous liq. . . . ", Bridgestone Tire KK Apr. 1988.

*Primary Examiner*—Paul Lieberman
*Assistant Examiner*—Gregory R. Delcotto
*Attorney, Agent, or Firm*—Sprung Horn Kramer & Woods

[57] ABSTRACT

The invention relates to an electrorheological liquid Which consists of an organic polymer as the polarizable disperse phase, an electrically non-conductive, non-aqueous continuous phase and a dispersing agent, and in which the disperse organic polymer has an average particle diameter of between 0.2 and 30 μm and a relative half width value of the particle diameter distribution of below 0.8.

7 Claims, No Drawings

ELECTROVISCOUS LIQUID

This invention relates to electroviscous liquids containing, as disperse phase, polymer particles or polymer-coated particles with small particle diameters and narrow particle diameter distribution.

Electroviscous liquids (EVF) are dispersions of finely divided solids in hydrophobic, electrically non-conductive oils whose viscosity changes very rapidly and reversibly from the liquid to a highly viscous, plastic or solid state under the influence of a sufficiently powerful electric field. The viscosity reacts both to electric DC fields and electric AC fields but the flow of current through the EVF should be very low. Electroviscous liquids may be used wherever large forces are required to be transmitted with little electric power, e.g. in clutches, hydraulic valves, shock absorbers, vibrators or devices for positioning and fixing workpieces.

In many known electroviscous liquids, the disperse phase consists of inorganic solids. EVF's based on silica gel are known from German Patent Specifications DE 3 517 281 and DE 3 427 499. Zeolites are used as disperse phase in EP 265 252. DE 3 536 934 describes the use of aluminosilicates. Spherical particles obtained by the hydrolysis and condensation of metal alkoxides, for example tetraethoxysilane, may also be used as disperse phase (EP 0 341 737). The use of "Organo Silica Sol" is described in JP 01 304 189 (CA 112 142 616). In the known systems, the electroviscous effect is due to the solids being charged with water. These systems generally produce advantageous electroviscous effects but they have a poor dispersion stability and unfavourable abrasive properties due to the high density and great hardness of the inorganic solids.

Electroviscous liquids based on polymer particles as disperse phase have also been proposed. Thus DE 2 820 494 proposes EVF's having a polymer containing free or neutralised acid groups. Substituted silicone resin as disperse phase is disclosed in DE 3 912 888. Surface treated polyalkylsiloxane powders are described in JP 01 266 191. JP 01 180 240 (CA 112 23 759) mentions composite particles obtained by the condensation of ionic polymer particles and special silicon compounds.

The electroviscous liquids hitherto known, based on polymer particles, are not able to meet all the requirements. In particular, it is difficult to obtain a high electroviscous effect combined with low basic viscosity, high dispersion stability and high shearing stability.

It is an object of the present invention to provide non-abrasive, sedimentation stable, electroviscous liquids which are distinguished by a high electroviscous effect, a low basic viscosity of below 100 mPa.s and a high shearing stability as well as good response times.

It was found that the average particle diameter and the particle distribution have an important influence on the electroviscous effect. Organic polymers as disperse phase have advantageous properties with regard to the abrasiveness.

The present invention thus relates to electrorheological liquids consisting of an organic polymer as polarizable disperse phase, an electrically non-conductive, non-aqueous continuous phase and a dispersing agent, the disperse phase having an average particle diameter of from 0.2 to 30 μm and a particle diameter distribution having a relative half width value below 0.8. The half width value is the quotient of the absolute half width value and the average particle diameter.

The average particle diameter is preferably from 0.5 to 20 μm, most preferably from 1 to 10 μm. Preferred particle size distributions of the disperse phase have relative half width values below 0.5, most preferably below 0.3.

Since many organic polymers suitable for the formation of the disperse phase have only a low electric polarizability, the phase according to the invention preferably contains a polar substance in solution. The use of such electrolytes to increase the magnitude of the electroviscous effect in polymer dispersions has been described in EP-A 0 472 991.

The polar substance used may be water and/or other electrolytes such as, for example, KCL, $LiNO_3$, $CH_3COONa$, $LiCLO_4$, $Mg(ClO_4)_2$, KSCN, LiBr, LiI, $LiBF_4$, $LiPF_6$, $NaB(C_6H_5)_4$, $LiCF_3SO_3$ and $N(C_2H_4)_4Cl$. $Li_2CO_3$, $ZnCl_2$, $ZnSO_4$, $ZnI_2$, $ZnBr_2$, $LiSO_4$ as well as other organic and inorganic salts of metal ions. Additionally electrolytes include the salts of organic anions, with metallic and nonmetallic cations, and the salts organic anions, with organic or inorganic anions.

Examples of salts with organic anions are the alkyl-, aralkyl-, and arylsulfonates, sulfates and phosphates, such as Alkylsulfonates $(RSO_4)_mM_n$ where: $R=C_1$-$C_{16}$ alkyl, Arylsulfonates $(RSO4)_mM_n$ where: R=phenyl, naphthyl, pyryl etc., Aralkylsulfonates $(RSO_4)_mM_n$ where: $R=C_8$-$C_{15}$ aralkyl (e.g. nonylphenyl) etc., Alkylsulfates $(RSO_3)_mM_n$ where: $R=C_2$-$C_{16}$ alkyl, Alkylpolyether sulfates $(RSO_3)_mM_n$ where: $R=C_2$-$C_{12}$ alkyl polyether with 2–20 ethylen oxide units, and Alkyl mono- and diphosphates where: alkyl=$C_2$-$C_{16}$ and where m and n depend on the relative charge of the ions.

These anions can be combined with suitable metal or organic cations such as those described elsewhere in the invention.

Examples of salts with organic cations are the alkyl-, and arylammonium salts, such as tetralkylammonium salts $(NR_1R_2R_3R_4)_mX_n$ where: $R_{1-4}$= $C_1$-$C_6$ alkyl and/or polyoxyalkylene groups alkylpyridinium salts $(py—R)_mX_n$ where: $R=C_2$-$C_{16}$ and where m and n depend on the relative charges of the ions.

Suitable anions X are the halogens, phosphates, sulfates, nitrates, acetates and other inorganic anions.

The organic anions described above in the invention can also be combined with organic cations to give particularly soluble salts.

The solution of the polar substance should extend over at least part of the surface of the dispersed particles but preferably over the whole volume of the particles.

The quantity of the electrolytes dissolved in the polymer particles may be up to 20% by weight in the case of water.

Quantities of from 0.4 to 8% by weight are preferred, and in the case of more powerfully polarizable electrolytes the quantities are preferably from 0.3 to 5% by weight.

The non-aqueous liquids used as dispersion medium forming the continuous phase may be, for example, hydrocarbons such as paraffins, olefins and aromatic hydrocarbons. Silicone oils such as polydimethylsiloxanes and liquid methyl phenyl siloxanes are also used. These may be used singly or as combinations of two or more types. The solidification point of the dispersion media is preferably adjusted to below −30° C. and the boiling point above 150° C.

The viscosity of the oils is from 3 to 300 $mm^2/s$ at room temperature. The low viscosity oils having a viscosity of from 3 to 20 $mm^2/s$ are generally to be preferred because they enable a lower basic viscosity of the EVF to be obtained.

To avoid sedimentation, the oil should also have a density approximately equal to the density of the disperse phase. Thus EVF's according to the invention which shows no signs of sedimentation for several weeks in spite of their low basic viscosity may be obtained, for example, by using fluorine-containing siloxanes either as pure substance or as a mixture with other silicone oils.

For preparing electroviscous liquids according to the invention which are exceptionally stable to sedimentation it is suitable to use fluorine-containing siloxanes having the following general structure:

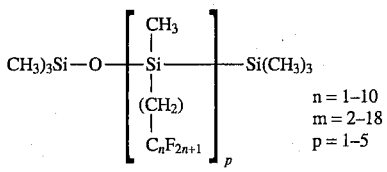

n = 1–10
m = 2–18
p = 1–5

The particulate polymer forming the disperse phase may be any solid or highly viscous polymer which has sufficient electric polarizability, in some cases due to the presence of dissolved electrolytes, and can be prepared in the particle size and particle size distribution according to the invention. Suitable methods of preparation include emulsion polymerization, suspension copolymerisation, etc. If the particle size distribution is not satisfactory, this can be corrected e.g. by means of filtration cascades. Preferred polymers, however, are those obtained by the production process in which the particles are directly obtained with the narrow particle size distribution according to the invention.

Thus according to DE-A 2 501 123, pulverulent maleic acid anhydride/l-olefin copolymers consisting of discrete spheres having a very narrow particle diameter distribution within about 10–30 μm in diameter and a relative half width value of the particle diameter distribution below 0.8 may be prepared by polymerising maleic acid anhydride with a greater than equimolar quantity of an l-olefin having 2 to 8 carbon atoms in an organic dispersion medium in the presence of a radical former and in the presence of a special dispersing agent soluble in the dispersion medium, employing the conditions of suspension polymerisation, the special dispersing agent being a reaction product of a copolymer of maleic acid anhydride and l-olefins having 2–8 carbon atoms with at least one primary, aliphatic, saturated or monoolefinically unsaturated straight chain or branched monohydric alcohol having 8 to 22 carbon atoms or at least one primary or secondary aliphatic, saturated, straight chain or branched monoamine having 8 to 22 carbon atoms or a mixture thereof. Full details of the process of preparation of the finely divided maleic acid anhydride/l-olefin copolymers are given in DE-A 2 501 123, DE-A 2 919 822 and DE-A 3 144 793.

Polymer particles according to DE-A-3 331 542 prepared in an aqueous/alcoholic phase by a radically initiated graft copolymerisation of a mixture of methacrylic acid and methyl methacrylate on the water-soluble salt of an alternating copolymer of maleic acid anhydride or maleic acid semi-amide and an α-olefin or styrene are also suitable for the invention. For details of the process of preparation, see DE-A 3 331 542.

Fluorine-containing bead polymers obtainable according to DE-A 3 708 032 are also suitable finely divided polymers for the invention.

Particularly preferred finely divided pearl polymers having a narrow particle size distribution are obtained according to EP-A 417 539.

Particularly preferred according to the invention are therefore electroviscous liquids whose disperse phase consists of particulate polymers cross-linked via Si—O—Si groups, in which the polymers contain a) from 50–99% by weight of polymerised vinyl monomer units and b) from 1–50% by weight of polymerised silane monomer units which are at least partially bridged by Si—O—S groups.

The particulate polymer cross-linked via Si—O—Si groups most preferably contain a1) from 10–90% by weight of polymerised hydrophilic vinyl monomer units, a2) from 0–90% by weight of polymerised non-hydrophilic vinyl monomer units and b) from 1–50% by weight of polymerised silane monomer units which are at least partially bridge by Si—O—Si groups.

The vinyl monomers for the cross-linked polymer are one or more compounds selected from substituted or unsubstituted straight chain, branched or cyclic olefins, diolefins or aromatic vinyl compounds, unsaturated carboxylic acids or derivatives thereof and vinyl derivatives of carboxylic acids.

The hydrophilic vinyl monomer units may be vinyl alcohols, acrylic and methacrylic acid and derivatives thereof such as (meth)acrylamide, N-alkyl substituted (meth)acrylamides, (meth)acrylic acid hydroxyalkylesters, (meth-)acrylic aminoalkylesters and (meth)acrylic acid carbonamidoalkylesters. The following are examples:

2-Hydroxyethylmethacrylate, 2-hydroxyethylethacrylate, 2-hydroxypropylacrylate, N-methylformamidoethylacrylate, 2-hydroxypropylacrylate, and N-methylformamidoethylmethacrylate. (Meth)acrylic acid may be used not only in its pure form but also in the form of its salts, in particular its alkali metal salts. Aminoalkyl (meth)acrylate may also be used in a protonated or quarternised form, for example N,N-dimethylaminoethylmethacrylate in the form of the hydrochloride. Other suitable hydrophilic monomers include those having sulphonate or phosphate groups, such as allyl sulphonic acid, vinyl sulphonic acid and styrene sulphonic acid. N-Vinylpyrrolidone, N-vinyl-morpholine and N-vinylcaprolactam are also suitable hydrophilic monomers.

Examples of suitable non-hydrophilic monomers include styrene, α-methylstyrene, vinyl toluene, substituted vinyl toluenes such as vinyl benzyl chlorides, butadiene, isobutylene, 2-chlorobutadiene, 2-methylbutadiene, vinyl pyridine, cyclopentene, cyclopentadiene and others; (meth-)acrylic acid esters such as ethyl methacrylate, butyl methacrylate, butyl acrylate, acrylonitrile and others; also, vinyl acetate, vinyl propionate and others. One or more vinyl monomers selected from styrene and the above-mentioned (meth)acrylic acid esters are preferably used, especially one or more (meth)acrylic acid esters.

The silane monomers used may be those corresponding to the following formula

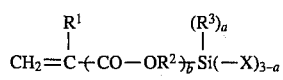

(I)

in which $R^1$ denotes hydrogen or methyl, $R^2$ denotes straight chain or branched $C_2$-$C_{12}$-alkylene in which the carbon chain may be interrupted by O, NH, COO or NH—COO, $R^3$ stands for a straight chain or branched $C_1$-$C_6$-alkyl or phenyl, X denotes a hydrolysable group, a has the value zero, one or two and b has the value zero or one.

Examples of straight chain or branched alkylenes having 2–12 carbon atoms include dimethylene, trimethylene, tetramethylene, pentamethylene, hexamethylene, octamethylene, decamethylene and dodecamethylene as well as 1,2-propylene, 1,2- and 1,3-butylene and similar well known branched structures. When the carbon chain is interrupted by O, NH, COO or NH—COO, the compounds belong in known manner to the series of polyethers, polyamines, oligoesters or oligourethane. A $C_2$-$C_8$-alkylene chain in which the carbon chain may be interrupted by O is preferred to a $C_2$-$C_{12}$-alkylene chain.

Examples of straight chain or branched $C_1$-$C_6$-alkyls include methyl, ethyl, propyl, isopropyl, butyl, isobutyl, tert.-butyl and the known $C_5$- and C6-hydrocarbon groups.

Hydrolysable groups on the Si atom are known to the man of the art and include, for example, halogen atoms such as fluorine, chlorine or bromine, in particular chlorine, alkoxy groups such as $C_1$-$C_6$-alkoxy, in particular methoxy or ethoxy, and carboxylate and carbonamido groups such as acetate, propionate, acetylamino or propionylamino.

X preferably stands for a chlorine atom or the above-mentioned alkoxy groups, especially methoxy or ethoxy.

The index a indicates that the Si atom carries at least one hydrolysable group but that up to two $C_1$-$C_6$-alkyl groups or phenyl may in addition be attached to the Si atom.

The index b indicates that the vinyl groups situated on the left in (I) may be attached to the Si atom either directly or by way of the carboxyalkylene group.

Index a preferably has the value zero and index b preferably has the value 1.

Preferred silane monomer units are therefore those corresponding to the formula $$CH_2{=}\overset{\overset{\displaystyle R^1}{|}}{C}{-}CO{-}OR^4{-}\overset{\overset{\displaystyle (R^3)_a}{|}}{Si}({-}X)_{3-a} \qquad \text{(II)}$$

in which $R^4$ denotes straight chain or branched $C_2$-$C_8$-alkylene whose carbon chain may be interrupted by —O— and $R^1$, $R^3$, X and a have the meanings indicated above.

It is particularly preferred to use silane monomer units corresponding to the following formula $$CH_2{=}\overset{\overset{\displaystyle R^1}{|}}{C}{-}CO{-}OR^4{-}SiX_3 \qquad \text{(III)}$$

in which $R^1$, $R^4$ and X have the meanings mentioned above.

The following are examples of suitable silane monomer compounds: Vinyl trimethoxysilane, vinyl triethoxysilane, vinyl methyl dimethoxysilane, vinyl methyl diethoxysilane, γ-methacryloyloxypropyl trimethoxysilane, γ-methacryloyloxypropyl triethoxysilane, γ-methacryloyloxypropyl-methyldiethoxysilane, γ-acryloyloxypropyl-trimethoxysilane, γ-acryloyloxypropyl-triethoxysilane, γ-acryloyloxypropyl-methyl-dimethoxysilane and γ-acryloyloxypropyl-methyldiethoxysilane.

The cross-linked polymer is in the form of discrete particles which form the disperse phase of the electroviscous liquid according to the invention. The form of the particles may be irregular: Thus, for example, they may be in the form of polymer splinters obtained by a grinding process. Rod-shaped and fibrous particles are also suitable, advantageously with an LD ratio (quotient of length to diameter) of from 1.5 to 20. The spherical form is particularly preferred.

The average particle diameter of the cross-linked polymers is from 0.1–30 μm, preferably from 0.5 to 20 μm, most preferably from 1 to 10 μm. The particle diameter distribution is preferably narrow and in many cases almost monodisperse. The particle diameter distribution may be determined by measuring the autocorrelation function of scattered laser light.

Preparation of the polymer is carried out by copolymerisation of the vinyl monomers (a) with the silane monomers (b). This may be carried out by known polymerisation processes described, for example, in Houben Weyl, Methoden der Organischen Chemie, 4th Edition, "Makromolekulare Stoffe", G. Thieme Verlag 1987. The silane monomer units initially incorporated in the polymer by polymerisation undergo a change in the course of further preparation so that the hydrolysable groups are at least partly split off by hydrolysis and the resulting Si—OH groups are converted into Si—OH—Si bridges by a condensation reaction.

In a preferred embodiment of the present invention, the polymer is prepared by polymerising the mixture of vinyl monomers and silane monomers in a non-aqueous, polar medium with the aid of a radical former as initiator in the presence of a polymer which is soluble in this medium and has a molecular weight $M_w$ of from $5{\cdot}10^3$ to $5{\cdot}10^5$, used in a quantity of from 0.5 to 15% by weight, based on the quantity of the polar medium, and in the further presence of a low molecular weight surface-active agent used in a quantity of from 0.2 to 5% by weight, based on the quantity of the medium, and then cross-linking the resulting polymer by the action of an aqueous acid or base.

The non-aqueous polar medium for the preparation of the preferred polymer may include one or more compounds selected from $C_1$-$C_8$-alkanols, open-chain or cyclic $C_4$-$C_8$-ethers, $C_1$-$C_6$-nitriles, $C_1$-$C_6$-acid amides, $C_3$-$C_6$-esters and $C_3$-$C_6$-ketones. The following are examples: Methanol, ethanol, propanol, i-propanol, butanol, i-butanol, tert.-butanol, hexanol, octanol, diethylether, dibutylether, dioxane, tetrahydrofuran, acetonitrile, propionitrile, dimethylformamide, methyl acetate, ethyl acetate, ethyl propionate, acetone, methyl ethyl ketone, methyl tert.-butyl ketone and other compounds known to the man of the art. The above-mentioned alcohols or a mixture thereof are preferably used, in particular $C_1$-$C_4$-alcohols.

For the polarity of the medium it is sufficient if the reaction medium contains at least 50% by weight of one or more of the above-mentioned polar compounds. The remainder, for example from 0.01 to 50% by weight of the reaction medium, may consist of apolar hydrocarbons or halogenated hydrocarbons such as hexane, heptane, benzene, chlorobenzene and others.

Polymerization is carried out with the aid of a radical polymerisation initiator. Such radical initiators are well known to one skilled in the art and include in particular peroxy compounds and azodiisobutyric acid nitrile. Such radical formers are used in a quantity of from 0.05 to 5%, preferably from 0.1 to 2%, based on the total quantity of the comonomers.

The polymerisation is carried out in the presence of a polymer which is soluble in the polymerisation medium and has a molecular weight $M_w$ of from $5{\cdot}10^3$ to $5{\cdot}10^5$, preferably from $10^4$ to $2{\cdot}10^5$. This soluble polymer is used in a quantity of from 0.5 to 15% by weight, preferably from 1 to 10% by weight, based on the quantity of the polymerisation medium. This polymer acts as dispersing agent and may be of natural or synthetic origin. The following are examples: Cellulose derivatives such as methylcellulose, ethylcellulose and hydroxypropylcellulose, vinyl acetate polymers such as propyl vinyl acetate, ethylene/vinyl acetate copolymers containing 50 to 90% by weight of vinyl acetate units in the copolymer, other vinyl acetate copolymers and partially saponified polyvinyl acetates, for example with a degree of saponification of 5–25% of all the acetate groups. Further examples of suitable polymers are: Poly-N-vinylpyrrolidone (PVP), substituted PVP, poly-N-vinylcaprolactam and its substituted derivatives, copolymers of PVP and vinyl caprolactam and other polymers which have the required molecular weight and solubility indicated above.

The preferred polymer is prepared in the presence of a low molecular weight surface-active agent used in a quantity of from 0.2 to 5% by weight, preferably from 0.5 to 2% by weight, based on the polymerisation medium. The surface-active agents may be non-ionic or ionic but are preferably ionic, most preferably cationic surface-active agents, which are basically known to the man of the art. Among the many surface-active agents, the sodium salts of sulphosuccinic acid esters are examples of anionic surface-active agents and N-alkylammonium salts such as methyl-tricaprylic ammonium chloride are examples of cationic surface-active agents, among others. The polymerisation temperature is in the range of from 50°–140° C. The polymerisation temperature and decomposition temperature of the radical initiator are adjusted to one another. The pressure is in principle not critical for the polymerisation and normal pressure is therefore preferably employed. A higher than normal pressure may be advantageous when polymerisation is to be carried out at an elevated temperature in a low boiling solvent. For temperature control, it is also preferred to operate at the boiling point of the polar polymerisation medium. When higher boiling reaction media are used it may therefore be advantageous to employ a slightly reduced pressure (evaporative cooling).

The polymerisation time amounts to several hours, in many cases 2–12 hours, and depends inter alia on the size and type of reaction mixture, as is well known.

The particle diameter of the preferred polymer may be controlled by the combination of the above-mentioned polymerisation parameters and may be determined by simple preliminary tests. One important polymerisation parameter is the polarity of the polarisation medium. It was found that the more highly polar the solvent, the finer are the particles. Thus, for example, the particle diameter decreases in the series: n-Propanol, ethanol and methanol used as polymerisation media. The particle diameter may thus be adjusted continuously to the desired value by mixing several of the above-mentioned compounds for the polar reaction medium.

A particle diameter of from 1 to 10 μm in particular, which is especially suitable for the electroviscous liquids according to the invention, may easily be adjusted by these means. A narrow particle diameter distribution is obtained by this method.

After termination of the polymerisation, the polymer obtained is treated with acidic or alkaline aqueous solutions to bring about cross-linking via the SiOH groups as described above and condensation of the said groups to Si—O—Si groups. Either acidic or alkaline solutions may be added to the polymerisation mixture for this purpose and the polymer may be obtained by filtration after the cross-linking process and washed if necessary. The acid or alkaline solutions used are aqueous acids or alkaline liquors, for example aqueous hydrochloric acid or sulphuric acid or aqueous sodium hydroxide or potassium hydroxide. The acid or alkaline solution is added in such a quantity to the polymerisatlon mixture or to the polymer which is to be filtered off that the polymerisatlon mixture or the slurry of filtered polymer in this water has a pH of from −1 to 3, preferably from 0 to 2, or from 11 to 14, preferably from 12 to 13. Acid hydrolysis and cross-linking is the preferred method. The quantity of acid or alkaline solution is not critical apart from the adjustment of the aforementioned pH, especially since the small quantity of water required for the at least partial hydrolysis and crosslinking is in any case always present. In the variation in which acidic or alkaline solution is added to the polymerisation mixture, it has been found suitable to use a proportion of about 10% by weight of acidic or alkaline solution, based on the polymerisation mixture. Hydrolysis and cross-linking may be carried out at a temperature of from 0°–50° C., preferably at room temperature. The reaction time is generally set at 15 minutes to several hours, depending mainly on the size of the reaction mixture.

The cross-linking reaction and the degree of crosslinking finally obtained may easily be monitored and controlled analytically by determination of the solubility in a suitable solvent such as tetrahydrofuran (THF), ethyl acetate or dimethylformamide. The polymers obtained at the first stage of polymerisation are readily soluble before the cross-linking reaction (gel content in tetrahydrofuran at 25° C. generally below 5%) but are insoluble after the cross-linking reaction (gel content in tetrahydrofuran at 25° C. greater than 90%). The form, size and particle diameter distribution of the polymer are not altered by the cross-linking reaction.

The polymer has a clearly defined water content. This water content becomes established as an equilibrium water content under controlled conditions of temperature and atmospheric moisture. At 20° C. and 60% relative humidity, the water content is generally from 0.4 to 8% by weight.

The electroviscous liquid according to the invention contains from 10 to 75% by weight of the polymer, preferably from 20 to 70% by weight, most preferably from 30 to 65% by weight.

The dispersing agents used for the disperse phase may be surface-active agents which are soluble in the dispersion medium, e.g. surface active agents derived from amines, imidazolines, oxazolines, alcohols, glycol or sorbitol. Soluble polymers may also be used in the dispersing medium. Suitable polymers for this purpose are, for example, those containing from 0.1 to 10% by weight of N and/or H and from 25 to 83% by weight of $C_4$-$C_{24}$-alkyl groups and having a molecular weight of from 5000 to 1,000,000. The N- and OH-containing compounds in these polymers may consist, for example, of amine, amide, imide, nitrile or 5- to 6-membered N-containing heterocyclic rings or an alcohol and the $C_4$-$C_{24}$-alkyl groups may be esters of acrylic or methacrylic acid. The following are examples of the above-mentioned N- and OH-containing compounds: N,N-Dimethylamino ethylmethacrylate, tert.-butylacrylamide, malei-imide, acrylonitrile, N-vinylpyrrolidone, vinylpyridine and 2-hydroxyethylmethacrylate. The above-mentioned polymeric dispersing agents generally have the advantage compared with low molecular weight surface-active agents of giving rise to dispersions which are more stable against sedimentation.

Dispersing agents based on polysiloxanes are preferably used for dispersing in silicone oil. Suitable examples include polysiloxanes modified with amino or hydroxyl groups. Polysiloxane-polyether copolymers are particularly suitable; such products are available commercially. Acrylic and methacrylic functional polysiloxane-polyether copolymers which are grafted onto the particle surface during polymerisation give especially stable dispersions. The dispersing agents or mixtures of various dispersing agents are used in quantities of from 0.1 to 12% by weight, preferably from 0.5 to 6% by weight, based on the EVF.

The viscosities of the electroviscous liquids according to the invention may be determined in a modified rotation viscosimeter as already described by W. M. Winslow in J. April. Phys. 20 (1949), pages 1137–1140.

The examples listed below were characterised by determining the basic viscosity V(0) and the relative increase in viscosity V(r). The measuring arrangement used and the definition of the physical magnitudes are described in detail in DE-A 40 26 881. The dispersion stability (resistance to sedimentation) and the abrasiveness were also investigated.

The electroviscous liquids according to the invention have suitable electrorheological properties which are particularly well suited to practical use. Moreover, they are stable against sedimentation for prolonged periods (several months) and are not abrasive.

This invention also comprises a functional element (device) containing an anode and a cathode and the electroviscous liquid according to this invention extending at least partly between said anode and said cathode, the function (property, mode of operation) of said element being altered by alteration of the electrical field between said anode and said cathode due to a resulting change of viscosity of said liquid. Such functional elements (devices) are known in principle.

Such functional elements comprise shock and vibration dampers, pneumatic valves, means for force transmission such as clutches, movement sensors.

Generally the function of such elements comprises influencing the flow of the liquid through a tube or hole, or the viscous friction between two planes (also concentric cylindrical planes), movable relative to each other, by the electrical field.

Examples for dampers are disclosed in DE-A 3 920 347, DE-A 4 101 405, DE-A 4 120 099, U.S. Pat. No. 4,790,522, U.S. Pat. No. 4,677,868, GB-A 1 282 568, DE-A 3 336 965, U.S. Pat. No. 5,014,829, EP-A 427 413, EP-A 183 039, DE-A 3 334 704, DE-A 3 330 205, U.S. Pat. No. 4,898,084.

Examples for clutches are disclosed in U.S. Pat. No. 4,802,560, U.S. Pat. No. 4,840,112, EP-A 317 186, U.S. Pat. No. 4,815,674, U.S. Pat. No. 4,898,266, U.S. Pat. No. 4,898,267, GB-A 2 218 758, DE-A 3 128 959, U.S. Pat. No. 2,417,850, U.S. Pat. No. 2,661,825.

Other functional elements are disclosed in WO 9 108 003 (electrohydraulic pump system for articifial hearts),
GB-A-2 214 985 (fluid flow control valve),
GB-A 3 984 086 (electroviscous vibrator),
DE-A 4 003 298 (hydraulic pump or motor).

EXAMPLES

Example 1

Preparation of a Spherical Polymer 28 g of Polyvinyl pyrrolidone, 4 g of methyl tricaprylic ammonium chloride and 0.32 g of azodiisobutyronitrile were dissolved in 800 ml of methanol in a reaction flask equipped with reflux condenser, stirrer and thermometer. To this solution were added 80 g of a mixture of 50 g of methyl methacrylate, 20 g of 2-hydroxyethylmethacrylate and 10 g of gamma-methacryloyloxypropyl trimethoxysilane. The mixture obtained was heated under reflux for 5 hours with stirring. It was then cooled to 25° C. and 50 ml of 1N HCL were added dropwise within 30 minutes. The pearl polymer was isolated by centrifuging, washed with methanol and dried under vacuum at 50° C. The product was finally conditioned at 20° C. for 24 hours.

Yield: 71 g Proportion insoluble in THF: 96% Average particle size: 5.5 μm Relative half-width value: 0.4 Water content: 3.1%

Example 2

Preparation of Another Spherical Polymer 56 g of Polyvinyl pyrrolidone, 8 g of methyl tricaprylic ammonium chloride and 0.32 g of azodiisobutyronitrile were dissolved in a mixture of 1200 ml of methanol and 400 ml of ethanol in a reaction flask equipped with reflux condenser, stirrer and thermometer. 120 g of a mixture of 50 g of methyl methacrylate, 25 g of methacrylic acid, 25 g lithium methacrylate and 20 g of gamma-methacryloyloxy propyltrimethoxysilane were added to the resulting solution. The mixture obtained was heated under reflux for 5 hours with stirring. It was then cooled to 25° C. and 75 ml of 1N HCL were added dropwise within 30 minutes.

Stirring was continued for 1 more hour at 30° C. and the pearl polymer was then isolated by centrifuging, washed with methanol and dried under vacuum at 50° C. The product was finally conditioned at 20° C. for 24 hours.

Yield: 108 g Proportion insoluble in THF: 93% Average particle size: 7.0 μm, K=0.19 Relative half width value: 0.5 Water content: 4.2%

Example 3

Electroviscous Liquids According to the Invention

The dispersing agent was dissolved in the carrier liquid in a stirrer apparatus and the polymer was then dispersed at room temperature, using a high speed stirrer. The dispersions had the compositions shown below.

a) 52% by weight of carrier liquid: Isododecane
   3% by weight of dispersing agent: Copolymer of 80% by weight of dodecylmethacrylate and 20% by weight of 2-hydroxyethylmethacrylate
   45% by weight of polymer from Example 1 b) 46% by weight of carrier liquid: Isododecane
   4% by weight of dispersing agent: Copolymer of 80% by weight of dodecylmethacrylate and 20% by weight of 2-hydroxyethylmethacrylate
   50% by weight of polymer from Example 1 c) 52% by weight of carrier liquid: Polydimethylsiloxane (viscosity at 25° C.: 5 $mm^2/s$, density 0.9 $g/cm^3$)
   3% by weight of dispersing agent: Reaction product of OH end stopped polydimethylsiloxane and aminopropyltriethoxysilane
   45% by weight of polymer from Example 1 d) 45% by weight of carrier liquid: Polydimethylsiloxane (viscosity at 25° C.: 5 $mm^2/s$, density 0.9 $g/cm^3$)
   4% by weight of dispersing agent: Reaction product of OH-end stopped polydimethylsiloxane and aminopropyltriethoxysilane
   51% by weight of polymer from Example 1 e) 46% by weight of carrier liquid: Isododecane
   4% by weight of dispersing agent: Copolymer of 80% by weight of dodecylmethacrylate and 20% by weight of 2-hydroxymethylmethacrylate
   50% by weight of Polymer from Example 2 f) 46% by weight of carrier liquid: Polydimethylsiloxane (viscosity at 25° C.: 5 $mm^2/s$, density 0.9 $g/cm^3$)
   4% by weight of dispersing agent: Reaction product of OH end stopped polydimethylsiloxane and aminopropyltriethoxysilane
   50% by weight of polymer from Example 2.

Example 4

Examination of the Electroviscous Liquids from Example 3

| EVF | V(O)* mPa · s | V(r)** % | Stability against sedimentation |
|---|---|---|---|
| 3a | 38 | 4200 | very good |
| 3b | 74 | 2700 | very good |
| 3c | 42 | 4500 | very good |
| 3d | 68 | 2300 | very good |
| 3e | 59 | 4800 | very good |
| 3f | 85 | 3300 | very good |

*at 25° C., shearing velocity 1000/sec, field strength 0 V/mm
**relative viscosity change at 25° C., shearing velocity 1000/sec, field strength 3000 V/mm Example 5

Comparison Example

To repeat Example 2 of Patent Specification DE 2 820 494, a 30% by volume dispersion of a polymethacrylic acid cross-linked with divinylbenzene in a polychlorinated diphenyl fraction was prepared. The relative viscosity change at 25° C., a shearing velocity of 1000/sec and a field strength of 3000 V/mm was 800%.

We claim:

1. An electrorheological fluid consisting of 45 to 75% of an organic polymer as polarizable disperse phase, an electrically non-conductive, non-aqueous continuous phase and a dispersing agent, the disperse organic polymer having an average particle diameter of from 0.2 to 30 μm and a relative half width value of the particle diameter distribution below 0.8, the electrorheological fluid having a basic viscosity below 100 mPas, the dispersed organic polymer containing A) from 50–99% by weight of polymerized vinyl monomer units, and B) from 1–50% by weight of polymerized silane monomer units which are at least partly bridged by Si—O—Si groups, derived from silane monomer units of the formula

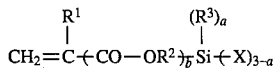

$R^1$ is hydrogen or methyl, $R^2$ is straight-chain or branched $C_2$-$C_{12}$-alkylene whose carbon chain may be interrupted by O, NH, COO or NH—COO, $R^3$ is straight-chain or branched $C_1$-$C_6$-alkyl or phenyl, X is a halogen atom, an alkoxy group, a carboxylate group or a carbon amido group, a is zero, one or two, and b is zero or one.

2. An electrorheological fluid according to claim 1, wherein the average particle diameter of the disperse organic polymer is from 0.5 to 20 μm.

3. An electrorheological fluid according to claim 1, wherein the average particle diameter of the disperse organic polymer is from 1 to 10 μm.

4. An electrorheological fluid according to claim 1, having relative half width value of the particle diameter distribution of at most 0.5.

5. An electrorheological fluid according to claim 1, wherein component A comprises A1) from 10–90% by weight of polymerized hydrophilic vinyl monomer units, and A2) from 0 to 90% by weight of polymerized non-hydrophilic vinyl monomer units.

6. An electrorheological fluid according to claim 1, wherein the polymer is present in the form of spherical internally cross-linked particles.

7. In an apparatus comprising an anode, a cathode and an electroviscous fluid at least partly therebetween, the operation of said apparatus being altered by alteration of the electrical field between said anode and cathode which results in a change in the viscosity of said electroviscous fluid, the improvement wherein said electroviscous fluid comprises an electroviscous fluid according to claim 1.

* * * * *